US006761039B1

(12) United States Patent
Gray

(10) Patent No.: US 6,761,039 B1
(45) Date of Patent: Jul. 13, 2004

(54) AIR CONDITIONER CONDENSING COIL COOLING SYSTEM

(76) Inventor: Jimmy C. Gray, 6298 Highway 165, Ravenel, SC (US) 29470

( * ) Notice: Subject to any disclaimer, the term of this patent is extended or adjusted under 35 U.S.C. 154(b) by 0 days.

(21) Appl. No.: 10/637,765

(22) Filed: Aug. 8, 2003

(51) Int. Cl.[7] ..... F25B 47/00
(52) U.S. Cl. ..... 62/279; 62/305; 62/506
(58) Field of Search ..... 62/183, 279, 280, 62/305, 506

(56) References Cited

U.S. PATENT DOCUMENTS

| | | | | |
|---|---|---|---|---|
| 2,145,380 A | | 1/1939 | Weiland | |
| 2,362,698 A | | 11/1944 | Hull | |
| 3,908,393 A | * | 9/1975 | Eubank | 62/305 |
| 4,266,406 A | * | 5/1981 | Ellis | 62/183 |
| 4,404,814 A | * | 9/1983 | Beasley et al. | 62/171 |
| 5,113,668 A | | 5/1992 | Wachs, III et al. | |
| 5,992,171 A | * | 11/1999 | Bacchus | 62/305 |
| 6,463,751 B1 | | 10/2002 | Teller | |

FOREIGN PATENT DOCUMENTS

JP 3550751139 A 6/1980

* cited by examiner

*Primary Examiner*—Melvin Jones
(74) *Attorney, Agent, or Firm*—McNair Law Firm, P.A.

(57) ABSTRACT

An air conditioner condensing coil cooling system comprising an evaporating unit inside a house having an evaporating coil for evaporating a refrigerant liquid and a condensing unit remote from the evaporating unit located outside the house having a condensing coil for cooling refrigerant gas into liquid refrigerant. A condensate collector included in the evaporating unit for collecting condensate that condenses on the evaporating coil. A drain line extending from the condensate collector out of the house and connecting to a pump outside the house for drawing the condensate through the drain line. A manifold positioned adjacent the condensing coil connected to the pump for receiving condensate from the condensate collector through the drain line. The pump forcing condensate through spray holes in the manifold to provide a pressurized spray of condensate being applied onto the condensing coil.

11 Claims, 3 Drawing Sheets

AIR CONDITIONER CONDENSING COIL COOLING SYSTEM

FIELD OF THE INVENTION

The present invention relates to air conditioner units, and more particularly, to a condensing coil cooling system for collecting condensate that condenses on the evaporating coil, and spraying the condensate on the condensing coil to provide increased operational efficiency by removing heat from the refrigerant prior to evaporation.

BACKGROUND OF THE INVENTION

The efficient operation of air conditioners is of ever increasing importance as energy cost continue to rise. Previous attempts to provide increased efficiency have resulted in various designs for applying water to the condensing coil to cool the liquid refrigerant prior to evaporation.

For example, U.S. Pat. No. 2,145,380 discloses a condensate disposal means for air conditioner units that includes collecting moisture from an evaporator and directing the condensate to the condensing unit which includes a blower for causing the condensate to be thrown randomly onto portions of the condensing coil.

U.S. Pat. No. 2,362,698 discloses gathering condensate in a drip pan and pumping the condensate to a single small spray head placed over a portion of the condenser coil for spraying the condensate onto the condensing coil.

U.S. Pat. Nos. 4,266,406 and 5,113,668 disclose cooling systems for spraying a mixture of condensate and tap water onto the condensing coil.

Several problems, however, exist with these prior art designs. Most notably, the systems fail to properly apply the condensate over large portions of the condensing coil and thereby fail to adequately cool the condensing coil to provide a significant increase in energy efficiency. Other designs require a supplemental water supply from a municipal water source or a well to unnecessarily saturate the condensing coil with water. This substantially increases operating costs and reduces any potential energy cost savings benefits that may result from cooling the condenser coil. Additionally, this supplement water contains harmful chemicals and minerals that collect on the condensing coil and reduce its ability to dissipate heat, thereby failing to provide increased efficiency. Other systems attempt to eliminate such harmful chemicals and mineral deposits by including additives in the water. This again substantially increases operating cost and reduces any potential energy savings.

Accordingly, it is an object of the present invention to provide an air conditioner condensing coil cooling system to increase operating efficiency of the air conditioner to result in energy cost savings without significantly increasing operating costs.

It is a further object of the present invention to dispose of the condensate produced by the air conditioner by spraying the condensate over the condensing coil to cool the condensing coil.

SUMMARY OF THE INVENTION

The above objectives are accomplished according to the present invention by providing an air conditioner condensing coil cooling system. In the preferred embodiment, the air conditioner includes an air handler located on an interior of a house for directing conditioned air throughout the house. An evaporating unit is carried within the air handler having an evaporating coil for cooling the air as is well known in the art. A condensing unit, remote from the air handler, is located outside the house and includes a condensing coil for cooling compressed refrigerant gas into liquid refrigerant, which is later evaporated in the evaporating coil.

A condensate collector is included in the evaporating unit for collecting condensate that condenses on the evaporating coil. However, instead of simply discharging the condensate onto the ground outside the house as is typically done, a drain line is provided that extends from the condensate collector out of the house and connects to a pump outside the house for drawing the condensate through the to drain line.

A manifold is included in the condensing unit that is connected to the pump. The manifold generally surrounds the condensing coil and includes a series of spray holes positioned facing the condensing coil. The pump cycles condensate through the manifold to supply a pressurized spray of misted condensate exiting from the spray holes and being applied directly onto the condensing coil to cool the condensing coil and provide increased efficiency in the operation of the air conditioner.

Advantageously, the more the refrigerant is cooled in the condensing coil, the more heat it can extract once it is evaporated in the evaporator coil, resulting in a more efficient air conditioner to cool the house. According to the present invention, a pressurized spray of cold water, in the form of a fine mist, distributed in a wide pattern over the condensing coil substantially increases the efficiency of the unit by extracting more heat from the refrigerant as the water evaporates on the condensing coil than would normally occur at ambient air temperature. As a result, the refrigerant is cooler when entering the evaporating coil and can extract more heat from the air passing over the evaporating coil inside the house. Notably, as temperature and humidity rise, the availability of condensate increases. Spraying the increased amount of condensate on the condensing coil causes efficiency to increase at the same time the load demand increases on the air conditioner to cool the house during high temperatures. This helps keep in check the peak power demands of the unit by reducing the amount of power normally needed during peak power demands. Not only does this provide energy savings to the homeowner while providing better cooling, but results in a reduction of the power company's problem with meeting peak power demand requirements of consumers during the hottest months of the year.

As noted above, supplemental water sources dramatically increase operating costs and are wasteful. Fortunately, condensate water, which is free and usually discarded, can be used as the cooling water to be sprayed on the condensing coil to provide the supplemental cooling effect for increased efficiency. Furthermore, designs that merely drip condensate water onto the condensing coil are inefficient as they fail to use the full potential of the condensate water to remove heat from the condensing coil. The present invention distributes the condensate water over a much larger area of the condensing coil by misting the condensate as it is sprayed out of the manifold under pressure, resulting in greater heat removal and increased operational efficiency.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
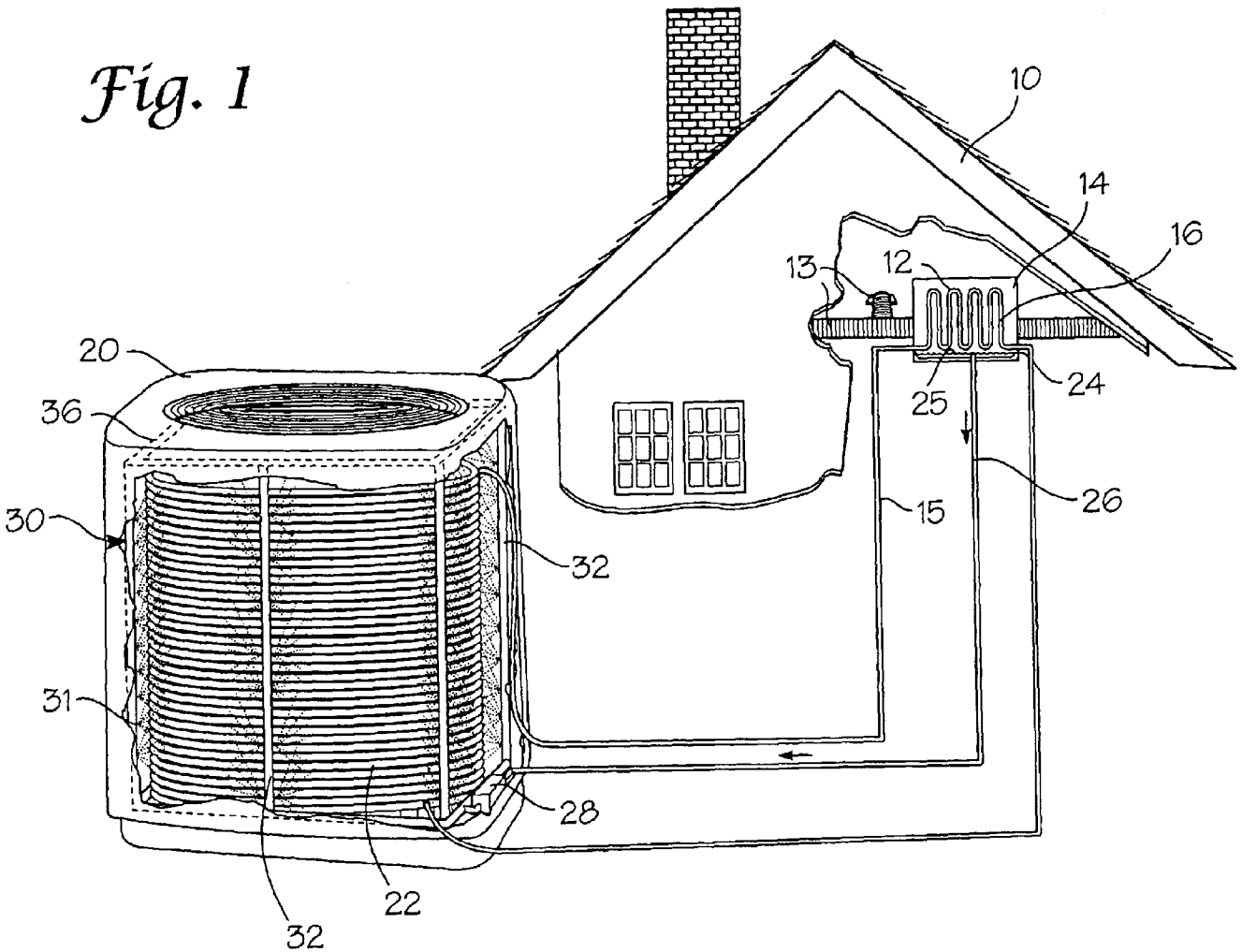
FIG. 1 shows an illustration of the condensing coil cooling system according to the invention.

With reference to the drawings, the invention will now be described in more detail. Referring to FIG. 1, a house 10 is shown having a split-system air conditioner design. The split-system includes an air handler, designated generally as 12, located on an interior of house 10 for directing conditioned air, whether hot or cold, throughout the house by way of air ducts 13. An evaporating unit 14 is carried within air handler 12 having an evaporating coil 16 for evaporating a refrigerant, commonly referred to as Freon, to cool the evaporating coil so that when air is directed over the evaporating coil, the air is cooled and then distributed by the air handler around the house.

A condensing unit 20, remote from air handler 12, is located outside house 10 and includes a condensing coil 22 for cooling compressed refrigerant gas into liquid refrigerant, which is later evaporated in the evaporating coil to absorb heat and cool the air. As is known in the art, the refrigerant is continuously cycled between the evaporating coil and condensing coil through a single continuous conduit 15, which compresses or evaporates the refrigerant at the appropriate portion of the conduit described above.

A condensate collector 24 is included in the evaporating unit for collecting condensate that condenses on evaporating coil 16. As humid air is passed over the evaporating cool, the cool refrigerant in the evaporating coil extracts the heat from the air and causes moisture to condense on the coil. The moisture then accumulates and drips into condensate collector 24. However, instead of simply discharging the condensate 25 onto the ground outside the house, as is typically done, a drain line 26 is provided that extends from condensate collector 24 out of house 10 and connects to a pump 28, specifically located outside the house, for drawing the condensate through the drain line. Preferably, as best shown in FIG. 1, pump 28 is advantageously included in the condensing unit to simplify installation and prevent damage to the pump, as well as prevent damage to the house in the event the pump were to fail and possibly leak condensate inside the house. Preferably, pump 28 is operatively connected to a float switch disposed in condensate collector 24 so that when the level of condensate drops below a predetermined level, the pump will shut off and not run dry. As long as sufficient condensate is available in the condensate collector, pump 28 will force the condensate into manifold 30 under pressure sufficient to spray the condensate out of spray holes 34, best shown in FIG. 2.

Figure 2:
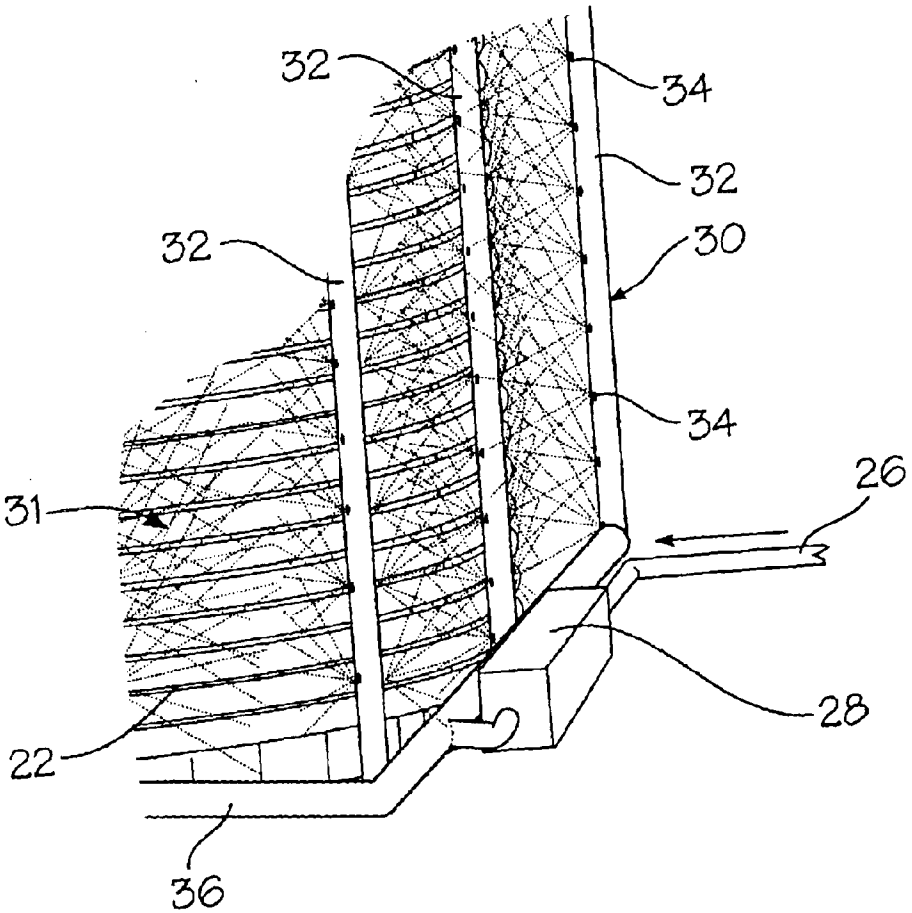
FIG. 2 shows a cut-away view of the condensing unit carrying the manifold according to the invention.

Referring to FIGS. 1 and 2, a manifold, designated generally as 30, is included in condensing unit 20. Manifold 30 is connected to pump 28 for receiving the condensate from drain line 26. Manifold 30 is constructed and arranged to include a plurality of fingers 32 spaced apart and located adjacent condensing coil 22 for surrounding the condensing coil. As noted above, a series of spray holes 34 are included in the manifold fingers, which are positioned facing condensing coil 22. Spray holes 34 are adapted for providing a condensate mist, designated generally as 31, exiting from manifold 30 onto condensing coil 22. Pump 28 cycles condensate through manifold 30 to supply a pressurized spray of condensate exiting from spray holes 34 and being applied directly onto condensing coil 22 to cool the condensing coil and provide increased efficiency in the operation of the air conditioner by removing excess heat from the refrigerant.

Figure 3:
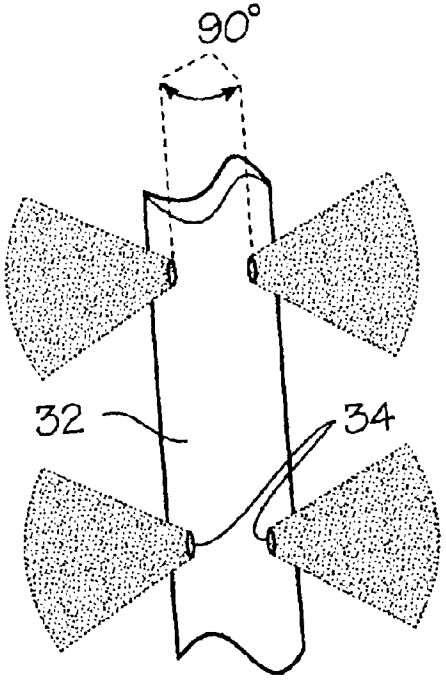
FIG. 3 shows a detailed view of the condensate spray holes according to the invention.
Figure 4:
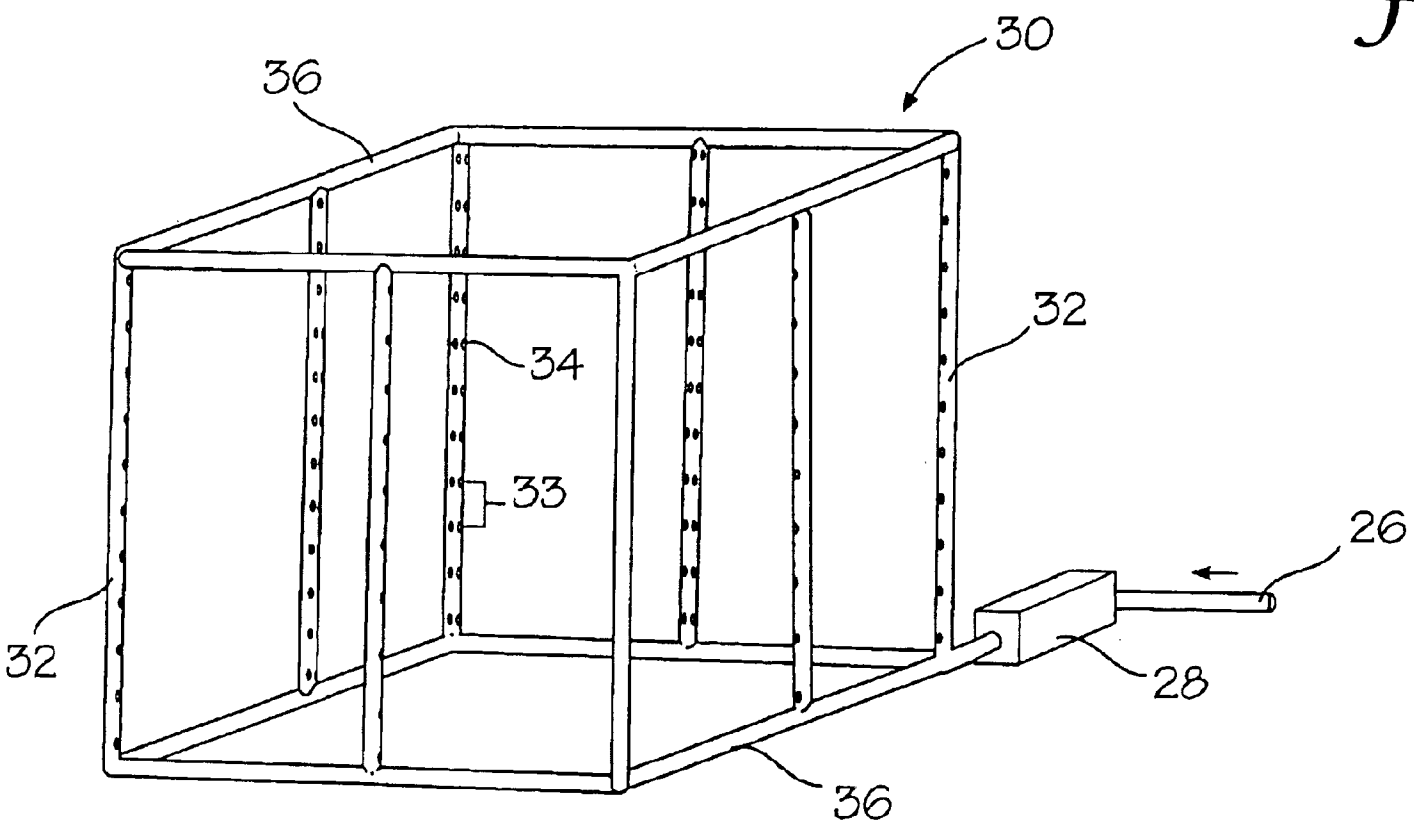
FIG. 4 shows the manifold and pump according to the invention separated from the condensing unit.

Referring to FIGS. 3 and 4, manifold 30 preferably comprises ⅜" tubing constructed and arranged with fingers 32 running vertically through the condensing unit. Fingers 32 are interconnected by horizontal running tube sections 36 to provide a closed loop arrangement for cycling the condensate through manifold 30 until it is sprayed onto condensing coil 22. Preferably, manifold 30 is constructed and arranged to cover at least one side of condensing unit 20. However, depending on the capacity of the air conditioner, and thereby the amount of condensate produced, manifold 30 may be constructed and arranged to cover all sides or only a single side of the condensing unit to provide the most complete coverage and the most energy efficient results possible for the amount of condensate produced by the evaporating unit. As the design of condensing units varies, manifold 30 may accordingly be adapted to surround other shapes and is not intended to be limited by the embodiment illustrated.

Additionally, as best shown in FIGS. 3 and 4, spray holes 34 comprise a plurality of holes vertically spaced along fingers 32 and arranged into two vertical rows on each finger. The vertical rows of spray holes are separated laterally by approximately 90° and aligned at a 45° angle to condensing coil 22 so that condensate mist 31 is sprayed out of fingers 32 in a widely dispersed pattern over the condensing coil to provide the most efficient coverage of the condensing coil. The size of the holes can be varied to provide anything from a misting type spray to a spray of larger droplets.

In the preferred embodiment, the size of hole is small to produce a fine mist that will rapidly evaporate and dissipate heat from the condensing coil quickly. However, the type of spray can be adapted depending on the capacity of the air conditioner and the amount of condensate being produced for distribution on condensing coil 22. For example, a smaller hole is preferred for small capacity air conditions of the type found in most homes, which do not produce large quantities of condensate. The small hole conserves condensate to be sprayed on the condensing coil so that a constant supply of condensate is available for use. Additionally, the small hole produces a rapidly evaporating fine mist, which quickly removes heat from the coil, ultimately requiring less condensate to be applied to the condensing coil since the condensate is applied most efficiently. Larger holes can distribute the condensate more quickly for high capacity evaporating units, but produce larger water droplets that do not evaporate as fast. While sill providing an efficient cooling effect, it is not as efficient as the misted condensate spray. As shown in FIG. 4, in the preferred embodiment, spray holes 34 are vertically spaced along fingers 32 approximately 3" apart, designated generally as 33, and comprise a 1/32" hole in the fingers, which produces a fine mist for smaller capacity air conditioners of the type used in most residential applications. Accordingly, the size of the hole may be adapted to the quantity of condensate to be produced by the evaporating unit, but the preferred embodiment provides a condensate that is misted onto the condensing coil.

While a preferred embodiment of the invention has been described using specific terms, such description is for illustrative purposes only, and it is to be understood that changes and variations may be made without departing from the spirit or scope of the following claims.

What is claimed is:

1. A split-system air conditioner condensing coil cooling system, said cooling system comprising:

an air handler located on an interior of a house for directing conditioned air throughout the house;

an evaporating unit carried within said air handler having an evaporating coil for evaporating a refrigerant;

a condensing unit remote from said air handler located outside said house and having a condensing coil for cooling refrigerant gas into liquid refrigerant;

a condensate collector included in said evaporating unit for collecting condensate that condenses on said evaporating coil;

a drain line extending from said condensate collector out of said house and connecting to a pump outside said house for drawing the condensate through said drain line;

a manifold included in said condensing unit connected to said pump;

said manifold having a plurality of fingers spaced apart and located adjacent said condensing coil; said fingers being interconnected in a closed loop arrangement and including a series of spray holes positioned facing said condensing coil;

said pump cycling condensate through said manifold to supply a pressurized spray of condensate exiting said spray holes and being applied directly onto said condensing coil to cool said condensate coil and provide increased efficiency in the operation of said air conditioner.

2. The cooling system of claim 1 wherein said pump is included in said condensing unit.

3. The cooling system of claim 1 wherein said manifold comprises tubing constructed and arranged with said fingers running vertically through said condensing unit and interconnected by horizontal running tube sections to provide said closed loop arrangement.

4. The cooling system of claim 3 wherein said spray holes comprise a plurality of holes vertically spaced along said fingers and arranged into two vertical rows on each finger; said vertical rows of spray holes being separated laterally by approximately 90° and aligned at a 45° angle to said condensing coil so that the condensate is sprayed out of the fingers in a widely dispersed pattern over the condensing coil to provide the most efficient coverage of the condensing coil.

5. An air conditioner condensing coil cooling system comprising:

an evaporating unit located within an interior of a house having an evaporating coil for evaporating a refrigerant liquid;

a condensing unit remote from said evaporating unit located outside said house having a condensing coil for cooling refrigerant gas into liquid refrigerant;

a condensate collector included in said evaporating unit for collecting condensate that condenses on said evaporating coil;

a drain line extending from said condensate collector out of said house and connecting to a pump outside said house for drawing the condensate through said drain line;

a manifold positioned adjacent said condensing coil connected to said pump for receiving condensate from said condensate collector through said drain line;

said manifold including a series of spray holes aligned facing said condensing coil; and said pump forcing condensate through said spray holes of said manifold to provide a pressurized spray of condensate mist applied directly onto said condensing coil to cool said condensate coil and provide increased efficiency in the operation of said air conditioner.

6. The cooling system of claim 5 wherein said manifold is included in said condensing unit.

7. The cooling system of claim 6 wherein said manifold includes a plurality of fingers spaced apart and located adjacent said condensing coil.

8. The cooling system of claim 7 wherein said fingers are interconnected in a closed loop arrangement for cycling condensate through said manifold until exiting through said spray holes.

9. The cooling system of claim 8 wherein said manifold comprises tubing constructed and arranged with said fingers running vertically through said condensing unit and interconnected by horizontal running tube sections to provide said closed loop arrangement.

10. The cooling system of claim 9 wherein said spray holes comprise a plurality of holes vertically spaced along said fingers and arranged into two vertical rows on each finger; said vertical rows of spray holes being separated laterally by approximately 90° and aligned at a 45° angle to said condensing coil so that the condensate is sprayed out of the fingers in a widely dispersed pattern over the condensing coil to provide the most efficient coverage of the condensing coil.

11. The cooling system of claim 10 wherein said pump is included in said condensing unit.

* * * * *